US008610021B2

(12) United States Patent
Campagnolle et al.

(10) Patent No.: US 8,610,021 B2
(45) Date of Patent: Dec. 17, 2013

(54) STACKER DEVICE FOR STACKING FLAT ARTICLES ON EDGE, AND A POSTAL SORTING MACHINE EQUIPPED WITH AT LEAST ONE SUCH DEVICE

(75) Inventors: Pierre Campagnolle, Allex (FR); Bruno Cartal, Montelier (FR); Jacques Chapelet, Portes les Valence (FR)

(73) Assignee: Solystic, Gentilly Cedex (FR)

( * ) Notice: Subject to any disclaimer, the term of this patent is extended or adjusted under 35 U.S.C. 154(b) by 247 days.

(21) Appl. No.: 13/142,343

(22) PCT Filed: Mar. 15, 2011

(86) PCT No.: PCT/FR2011/050518

§ 371 (c)(1), (2), (4) Date: Jun. 27, 2011

(87) PCT Pub. No.: WO2011/117509

PCT Pub. Date: Sep. 29, 2011

(65) Prior Publication Data

US 2012/0234738 A1 Sep. 20, 2012

(51) Int. Cl.
*B07C 5/00* (2006.01)
*B65H 1/02* (2006.01)

(52) U.S. Cl.
USPC ..... 209/584; 271/150; 271/181

(58) Field of Classification Search
USPC ..... 271/149, 150, 152, 177, 178, 179, 180, 271/181; 209/584, 900
See application file for complete search history.

(56) References Cited

U.S. PATENT DOCUMENTS

| | | | | | |
|---|---|---|---|---|---|
| 4,052,052 | A | * | 10/1977 | Muller | 271/157 |
| 4,643,626 | A | | 2/1987 | Noguchi et al. | |
| 5,092,574 | A | * | 3/1992 | Braen et al. | 271/2 |
| 5,379,992 | A | * | 1/1995 | Holmes et al. | 271/2 |
| 5,657,982 | A | * | 8/1997 | Holmes et al. | 271/149 |
| 5,829,742 | A | * | 11/1998 | Rabindran et al. | 271/150 |

(Continued)

FOREIGN PATENT DOCUMENTS

| | | |
|---|---|---|
| DE | 58745 | 11/1967 |
| FR | 1399480 | 5/1965 |

(Continued)

OTHER PUBLICATIONS

Australian Office Action, Patent Examination Report No. 1, Date of Issue: Mar. 20, 2013, Patent Application No. 2011231436, 3 pages.

*Primary Examiner* — Joseph C Rodriguez
(74) *Attorney, Agent, or Firm* — Rothwell, Figg, Ernst & Manbeck P.C.

(57) ABSTRACT

A sorting outlet device including a support surface on which a stack of flat articles is formed by accumulation as the flat articles are inserted, accumulated, and pushed on-edge one-by-one in a main direction against a retaining element for retaining the stack, which element is provided at the front end of the stack. The support surface is mounted to be free to move in translation in the main direction, being moved synchronously with the movement of the retaining element in the main direction. The retaining element is also mounted to move relative to the frame under the effect of accumulation of said articles and associated with means of the winder or counter weight type arranged so as to exert a return force on the stack of flat articles in such a manner as to retain it. A postal sorting machine is equipped with at least one such stacker device.

7 Claims, 2 Drawing Sheets

(56) References Cited

U.S. PATENT DOCUMENTS

| | | | | |
|---|---|---|---|---|
| 6,494,446 | B1 * | 12/2002 | Tomiyama et al. | 271/91 |
| 7,344,134 | B1 | 3/2008 | Keane et al. | |
| 7,497,435 | B2 * | 3/2009 | Chastain et al. | 271/150 |
| 8,191,890 | B2 * | 6/2012 | Franzone et al. | 271/149 |

FOREIGN PATENT DOCUMENTS

| | | | |
|---|---|---|---|
| FR | 2372759 | | 6/1978 |
| FR | 2526772 | | 11/1983 |
| FR | 2 552 743 | A1 | 4/1985 |
| FR | 2552743 | | 4/1985 |

* cited by examiner

STACKER DEVICE FOR STACKING FLAT ARTICLES ON EDGE, AND A POSTAL SORTING MACHINE EQUIPPED WITH AT LEAST ONE SUCH DEVICE

CROSS REFERENCE TO RELATED APPLICATION(S)

This application is a 35 U.S.C. §371 National Phase Entry Application from PCT/FR2011/050518, filed Mar. 15, 2011, designating the United States and also claims the benefit of French Application No. 1052233, filed Mar. 26, 2010, the disclosures of which are incorporated herein by reference in their entirety.

TECHNICAL FIELD

The invention relates to a stacker device for stacking flat articles on edge, and to a postal sorting machine equipped with at least one such stacker device.

PRIOR ART

In the meaning of the invention, a "flat article" is, particularly but not exclusively, a mailpiece. Mailpieces that are suitable for being stacked by means of the stacker device of the invention may be of various dimensions, and may also have a variety of mechanical properties, in particular as regards stiffness. The mailpiece may, inter alia, be an ordinary letter, a magazine, an envelope with or without a window, a newspaper, or a catalog wrapped in a plastics or paper envelope, with or without bellows.

A stacker device is usable, in particular, in postal sorting installations, e.g. for the purpose of forming a buffer receptacle for mailpieces at each sorting outlet of the installation. A sorting machine conventionally has a feed inlet with a magazine, and an unstacker for putting the mailpieces in series on edge. The mailpieces are then generally conveyed towards an acquisition system, and then directed towards sorting outlets that are in side-by-side alignment. Conventionally, a stacker device, such as the stacker device of the invention, equips each of said sorting outlets.

In known manner, the stacker device defines a zone of variable size, making it possible to receive the stack of articles that accumulate in a longitudinal direction. That zone is edged transversely by a "jogging" edge against which the articles of the stack can come to bear. In addition, the front end of said stack comes to bear against a paddle that is movable longitudinally under the effect the accumulation of the articles. Said paddle exerts a return force on said articles, enabling the articles to be held in their on-edge position.

In addition, the articles come to bear, via their edges on a support surface, along which they slide as they accumulate. Finally, a rotary actuator is caused to move on arrival of each article going towards the article-receiving zone. Thus, the actuator periodically generates a longitudinal thrust force, either directly on the paddle on arrival of the first articles, or on the stack that is being formed.

That known arrangement suffers from drawbacks. It has been observed that, at a certain stage during formation of the stack, the mailpieces adjacent to the paddle tend to lose contact therewith. This therefore causes the stack to slump, which is disadvantageous in particular in that it prevents a stable stack of long length from being formed.

In addition, U.S. Pat. No. 4,643,626 discloses a stacker device for stacking flat articles of the card type. That device comprises two motor-driven toothed belts. Those belts, which are mounted to move in the stacking direction, ensure that the paddle is moved in controlled manner as new cards arrive. Such new cards are blocked between two successive teeth on the belt, while sliding along stationary support surfaces that are in the form of strips and that extend along the path of the belts. The paddle is coupled to a guide bar relative to which it can slide and pivot. The position of the edge of the paddle between two teeth of one of the toothed belts makes it possible to synchronize movement of the paddle with movement of the toothed belts.

In addition, Patent Application FR 2 372 759 also discloses a stacker document for stacking flat documents on edge. That device includes a support that is inclined relative to the horizontal, and on which the documents are stacked. That stacker device also has a toothed belt serving as a support surface for the documents as they are stacked. A retaining element is coupled to that endless toothed belt via a clutch wheel, itself coupled to a spring that thus urges the retaining element towards the point of arrival of the documents. The toothed belt is driven by a wheel mechanically connected to a ratchet wheel having pawls coupled to a counting circuit for counting the stacked documents. Every time a determined number of stacked documents have been detected by the counting circuit, the toothed belt is moved over a predetermined distance.

In addition, Patent Application FR 2 552 743 describes a device for stacking flat documents in receptacles. In a first version, that stacker device has a support surface formed by a conveyor belt guided by holding rollers and motor-driven directly or otherwise. That conveyer belt is inserted into the bottom of the receptacle suitable for receiving the boxes in which the documents are to be stacked. By being motor-driven, the conveyor belt assists inserting the documents into the receptacle, and the advance of the conveyor belt is preferably servo-controlled to the position of the top of the stack. The stack of documents is held by a paddle carried by a rail via a carriage and is constantly urged by a return spring back towards the point of arrival of the documents. The bottom edge face of the paddle rests on the conveyor belt. The paddle thus moves with the conveyor belt. In a second version, the conveyor belt is replaced with a set of smooth bars forming the support surface. The support surface is thus stationary.

U.S. Pat. No. 7,344,134 describes a flat-document stacker device including a stationary support surface through which grooves are provided that receive a belt coupled to a retaining element. The belt is motor-driven and suitable for moving the retaining element as a function of the size of the stack that is detected by the detector means.

In addition, Patent DE 58 754 describes a brochure stacker device having a conveyor belt, driven by wheels, the brochures being received, on edge, on the conveyor belt. The conveyor belt is coupled to a ratchet wheel arranged so that, once the stack has reached a certain thickness, advance of the conveyor belt is inhibited. The stack can thus be removed. While the brochures are being stacked, the stack is also held, by a plate that is urged back permanently by return means towards the zone in which the brochures are inserted.

Finally, Patent FR 2 526 772 describes a stacker device for stacking workpieces of fabric having hemmed edges. With that stacker device, the workpieces are received on edge, by flexible bands that are guided by pulleys. A vertical support is constrained to move with the flexible bands and is urged permanently by a drum back towards the point of arrival of the workpieces in order to hold the stack.

Those alternative solutions suffer from additional drawbacks related, in particular, to the presence of motors or of drive means. Such motors or drive means involve significant extra costs, while also being difficult to control.

In addition, French Patent FR 1 399 480 describes a stacker device for stacking flat documents in transportable boxes, that stacker device having a support surface suitable for receiving the boxes in which the documents are to be stacked. That support surface is in the form of two endless belts made of a flexible material having a low coefficient of friction. That stacker device also has a retaining element disposed in the box to be filled so as to retain the documents as they are stacked. The bottom edge of that retaining element is attached to the endless belts, which are free. The retaining element is thus free. That device does not make it possible to form stacks of flat articles on edge while also preventing the stack from slumping.

SUMMARY OF THE INVENTION

An object of the invention is to remedy the various drawbacks of the prior art that are presented above. A particular object of the invention is to propose a device that allows flat articles on edge to be formed into a stack of long length, while also preventing said stack from slumping. Another object of the invention is to provide such a device that is reasonable in cost, that is simple in structure, and that is convenient to operate.

To this end, the invention provides a stacker device for stacking flat articles on edge, which device comprises a frame supporting a support surface on which a stack of said flat articles is formed as the flat articles are inserted and pushed on-edge one-by-one in a main direction against a retaining element for retaining the stack, which element is provided at the front end of said stack, said retaining element being mounted to move relative to the frame and being associated with means arranged so as to exert a return force on the stack of flat articles in such a manner as to retain it, said stacker device being characterized in that the support surface is mounted to be free to move in translation relative to the frame in the main direction, and is moved synchronously with the movement of the retaining element in said direction.

The basic idea of the invention is to synchronize the respective movements of the retaining element and of the edges of the mailpieces standing on the support surface. This makes it possible to avoid cumulative excessive movements between the mailpieces and the retaining element, thereby imparting high stability to the stack that is formed in this way.

According to other advantageous characteristics of the stacker device of the invention:

- it further comprises a synchronization member that is distinct from the support surface, which synchronization member is constrained to move in translation in the main direction both with the retaining element and with the support surface;
- the support surface comprises at least one smooth belt;
- the or each smooth belt is wrapped around a series of rollers mounted to be free to rotate on the frame;
- the synchronization member is a toothed belt mounted to be free to move on the frame, and the retaining member has a lug suitable for co-operating with two adjacent teeth of said toothed belt;
- two support smooth belts are placed on either side of the central toothed belt;
- the synchronization member is a chain suitable for co-operating with a lug or with a cog on the retaining member;
- in operation, the flat articles are not in contact with the synchronization member; and
- neither the synchronization member nor the support surface is provided with drive means.

The invention also provides a postal sorting machine having sorting outlets, said postal sorting machine being characterized in that each sorting outlet includes a stacker device as defined above.

BRIEF DESCRIPTION OF THE DRAWINGS

The invention can be better understood on reading the following description given by way of example that is in no way limiting on the invention, and with reference to the accompanying drawings, in which.

DESCRIPTION OF EMBODIMENTS

Figure 1:
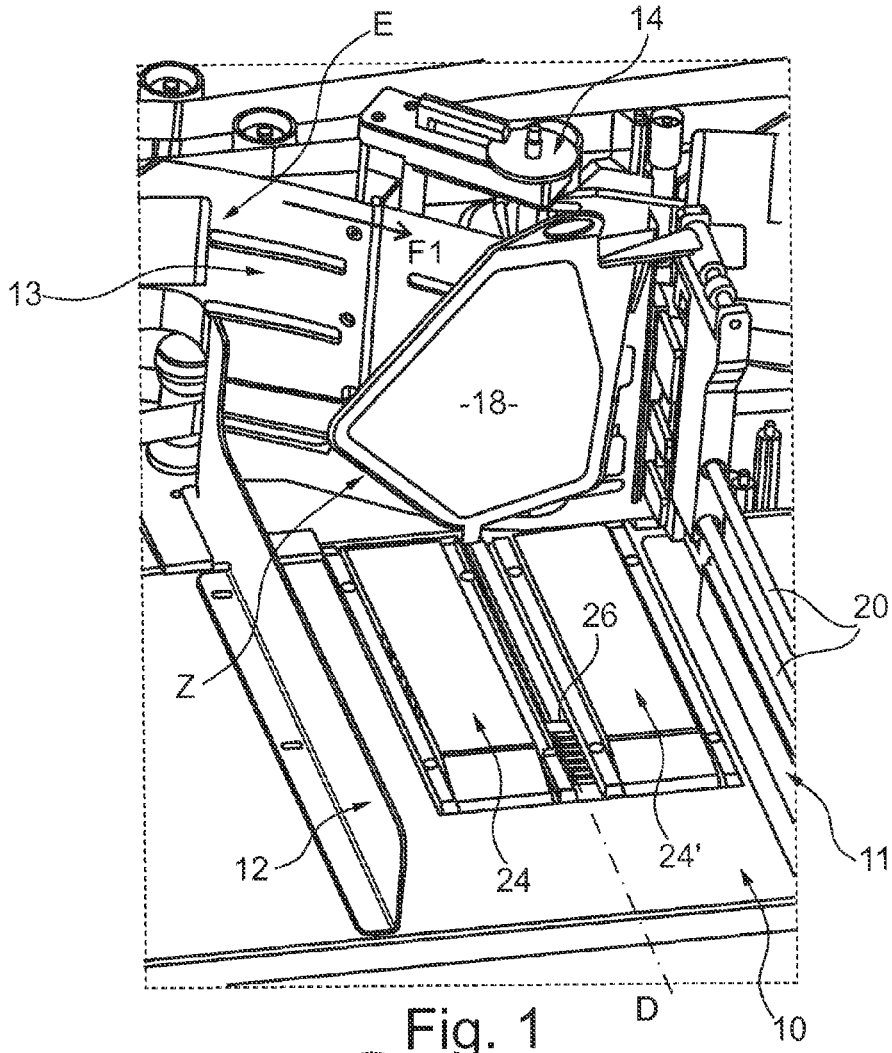
FIG. 1 is a perspective view of a stacker device of the invention.

The stacker device of the invention includes firstly a stationary frame that is designated by reference 10. It also has an inlet E that corresponds to the point of arrival of the flat articles. Typically, this inlet is put into communication with a conveyor device (not shown) that is part of a conventional-type sorting machine.

This stacker device further defines an article-receiving zone Z for receiving flat articles, which zone is flanked on one side by a jogging edge 11, against which the flat articles bear, and on the other side by a retaining edge 12. The longitudinal direction of the device is referenced D, and the stack of articles moves in said longitudinal direction as the stack is being formed. A plate 13 makes it possible to guide, as indicated by the arrow F1, the flow of articles admitted from the inlet E towards the zone Z.

An actuator 14 that is suitable for being driven in rotation as indicated by arrow f1 is placed at a first longitudinal end of the zone Z. It is equipped with actuating elements 16 that are suitable for pushing the stack being formed in the direction D, namely as indicated by arrow F2 in FIG. 3. This actuator is of conventional type and is shown highly diagrammatically.

The longitudinal end of the article-receiving zone that is opposite from the actuator is defined by a paddle 18 forming a retaining element in usual manner. This paddle is mounted to move relative to the frame, in the direction D, by being mounted on a guide 20. It can be retracted in known manner by pivoting about the guide as indicated by arrow f2. In addition, means (not shown) of the winder or counterweight type, are associated with the paddle so that said paddle exerts a return force on the stack of articles, in such a manner as to retain said stack.

Figure 3:
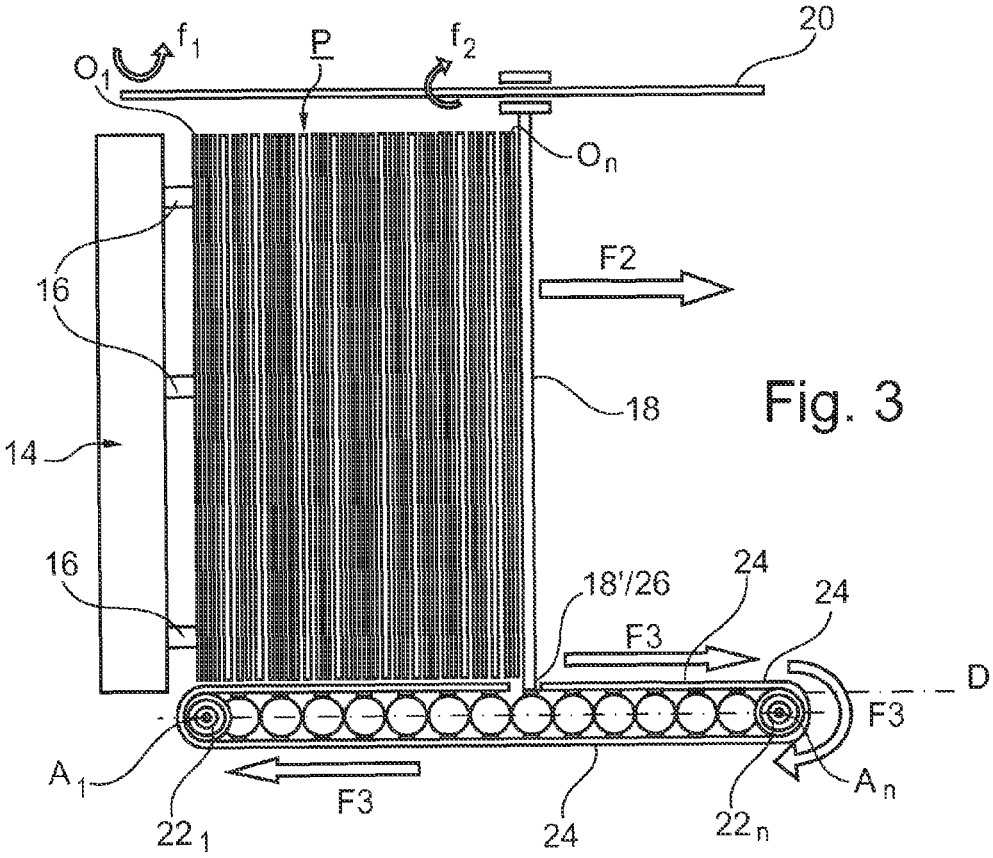
FIG. 3 is a side view of said stacker device, more particularly showing how a stack is formed.

The frame also supports two series of rollers disposed symmetrically about a longitudinal middle axis of the device. One of the sets of rollers is shown in FIG. 3, it being understood that the other set is analogous. The various rollers, referenced 221 to **22*n* have axes of rotation A1** to An that extend perpendicularly to the direction D. Said rollers are mounted to be free to rotate on the frame, i.e. they are not provided with any motor drive for driving them in rotation.

A smooth belt 24 forming a support for the edges of the flat articles as explained below is itself wrapped around said rollers. The surface of said belt 24 is therefore suitable for moving in the direction D, simultaneously with the rotation of the rollers about their axes. Reference 24' designates the other smooth belt that is analogous to the belt 24, and that is disposed in the vicinity of the edge 11.

A toothed belt 26 also extends between the two smooth belts 24 and 24', approximately midway therebetween, namely substantially along the longitudinal middle axis. As explained below, this belt 26 makes it possible to synchronize the respective movements in the direction D of the support smooth belts 24, 24' and of the paddle 18. This toothed belt is mounted to move freely on the frame, by any appropriate means such as rollers, analogous to the above-described rollers.

Link means 28 make it possible to constrain the various belts to move in translation with one another in the direction D. These link means that are of any suitable conventional type are shown diagrammatically in FIG. 2. It should also be noted, also with reference to FIG. 2, that the bearing surfaces of the smooth belts extend above the bearing surface of the toothed belt. In other words, the toothed belt does not act as a support for the flat articles, such as article O shown in this figure.

Finally, the paddle 18 is provided with a lug 18' that, in operation, penetrates between two adjacent teeth on the belt 26. This thus makes it possible for the paddle to be constrained to move with this belt, at least in translation in the direction D. By way of a variant (not shown), the toothed belt may be replaced with a chain that then co-operates with a lug or with a cog carried by the paddle.

Operation of the above-described stacker device of the invention is explained below.

At rest, the stacker device is empty of any flat article. Under these conditions, the paddle 18 is urged back into the vicinity of the actuator 14. Then, when arrival of the first article is detected, the actuator is caused to be moved in rotation so that said actuator pushes the paddle directly as indicated by arrow F2 in FIG. 3. The first article is thus interposed between the actuator and the paddle, while coming into abutment against the jogging edge 11. In addition, any rebounding of said article is limited by the retaining edge 12.

The arrival of the immediately following articles contributes to forming a stack of small thickness, which stack does not yet have any damping property. Under such conditions, during this initial stage, the actuator being caused to move in rotation continues to generate a thrust force that is exerted directly on the paddle, because it is not absorbed by the thin stack of articles.

During this first operating stage, the movement of the paddle 18 in the direction D, caused by the actuator, is accompanied by a corresponding movement of the toothed belt 26, due to said toothed belt co-operating with the lug 18'. In addition, due to the presence of the link means 28, the smooth belts 24 and 24' are also caused to move.

Then, as additional flat articles arrive, the thickness of the stack being formed increases, thereby imparting a damping property to said stack. Under such conditions, the thrust force generated by the actuator is exerted on the stack proper, rather than directly on the paddle, since said thrust force is absorbed by the mutually touching juxtaposed flat articles.

This force thus tends to push the stack, which, in turn, drives the two smooth belts. This is made possible by the fact that said smooth belts are mounted to be free to move, so that causing them to move is accompanied by only very low friction. Movement of the smooth belts causes movement of the toothed belt, and of the paddle. Thus, the thrust force from the actuator is passed on to the entire assembly made up of the stack of articles and of the paddle.

FIG. 3 shows the movements of the various above-mentioned mechanical members. It shows the stack P of flat articles O1 to On, while the arrow F2 represents the advance of the stack opposite from the actuator. Finally the arrows F3 represent the movement of each smooth belt, in particular the movement of its top face under the effect of the advance of the stack P.

The invention makes it possible to achieve the above-mentioned objects.

Figure 2:
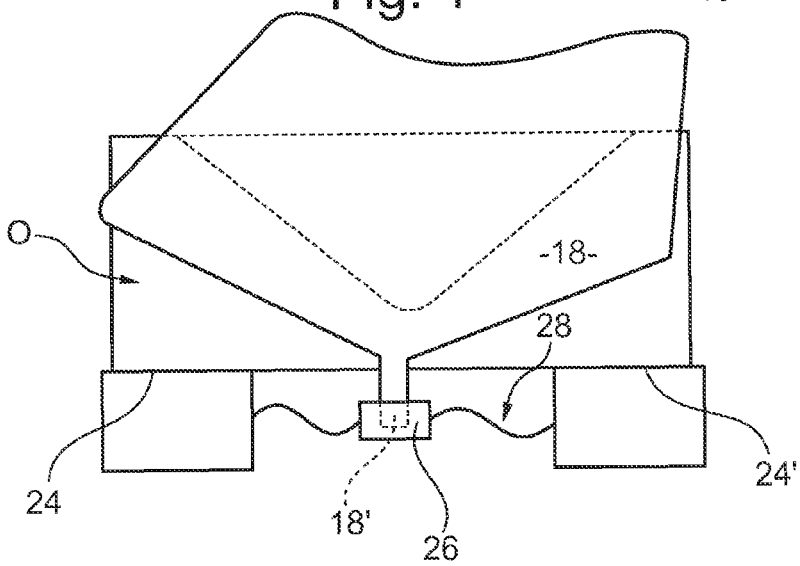
FIG. 2 is a front view of the stacker device shown in FIG. 1.
Figure 4:
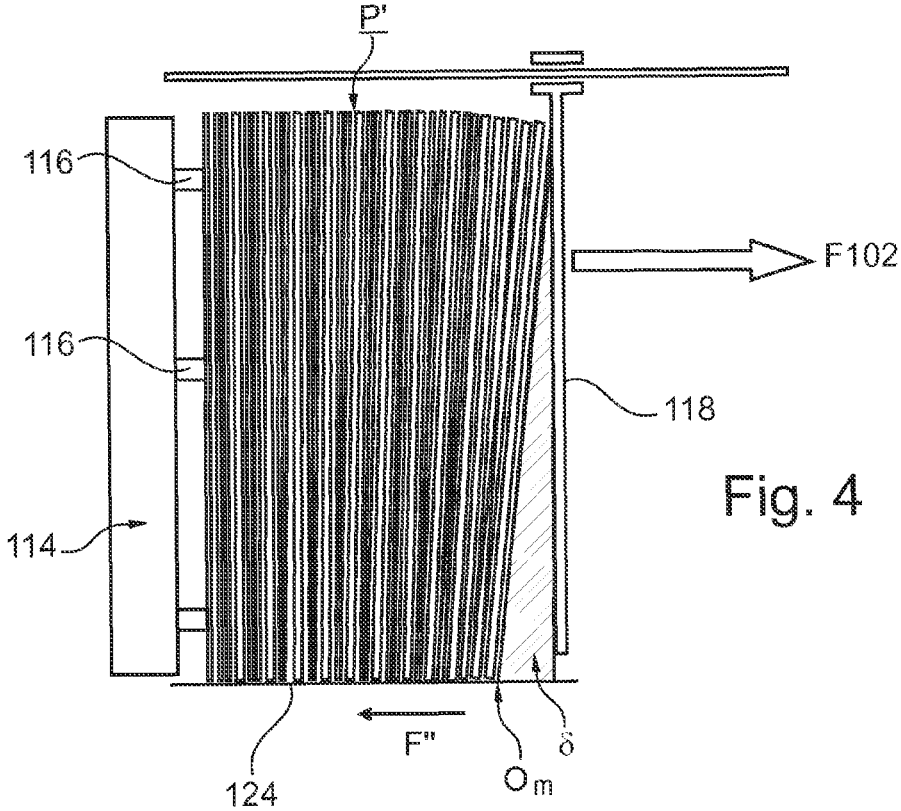
FIG. 4 is a side view, analogous to FIG. 3, showing how a stack is formed in a prior art device.

It should be noted firstly that the Applicant deserves credit for having identified the causes of the stack collapsing in the prior art. To this end, FIG. 4 shows a conventional stacker device, in which the mechanical elements that are analogous to the mechanical elements of FIGS. 1 to 3 are given like reference numbers, plus 100.

The above-mentioned collapsing is mainly due to the force exerted by the stack P' against the paddle 118, which force tends to become very high, in particular when the articles have low stiffness, in comparison to their weights. As shown in FIG. 4, this thrust force, represented by the arrow F102, is accompanied by the edges of the articles slipping along the support surface 124, which is stationary in the prior art.

Whenever this slippage, represented by the arrow F", becomes too large, the edge of the flat article Om adjacent to the paddle, tends to move away from the paddle 118, thereby generating an offset δ. Under these conditions, the stack collapses as the articles accumulate, which explains why known devices cannot enable long stacks to be formed stably.

With a view to overcoming this problem, a solution consisting in increasing the return force of the paddle in order to oppose the force induced by the stack, is not viable. In practice, such a return force must be of reasonable magnitude in order to enable stacking to take place.

The invention allows the edges of the articles resting on the smooth belts to move synchronously with the paddle that is constrained to move with the toothed belt. This therefore makes it possible to avoid cumulative offsets between the respective movements of the paddle and of the edges of the articles, which offsets are responsible for the stack collapsing in the prior art. It has thus been observed that the invention allows stacks of long lengths to be formed, e.g. of lengths greater than 30 centimeters, of floppy flat articles such as magazines.

In addition, the stacker device of the invention is mechanically very simple. To this end, it is advantageous to provide a support member for supporting the articles, which member can be driven by said articles as the stack is being formed. It is not necessary to provide a specific drive member that induces extra weight and additional manufacturing costs, and that requires a specific control system.

The invention claimed is:

1. A sorting outlet device for stacking flat articles on edge, said device comprising:

a frame supporting a support surface on which a stack of said flat articles can be formed by accumulation;

a retaining element disposed at a front end of the stack for retaining the stack as the flat articles are inserted, accumulated, and pushed on-edge one-by-one in a main direction against the retaining element, said retaining element being mounted to move relative to the frame under the effect of accumulation of said articles and being associated with means arranged so as to exert a return force on the stack of flat articles in such a manner as to retain the stack of flat articles;

a synchronization member that is distinct from the support surface, the synchronization member being constrained to move in translation in the main direction both with the retaining element and with the support surface, wherein the support surface comprises at least one smooth belt wrapped around a series of rollers mounted to be free to rotate on the frame, said support surface being mounted to be free to move in translation relative to the frame in the main direction, wherein the support surface is configured to move synchronously with the movement of the retaining element in said direction, wherein the synchronization member is a toothed belt mounted to be free to move on the frame, and wherein the retaining member has a lug suitable for co-operating with two adjacent teeth of said toothed belt.

2. The sorting outlet device according to claim 1, wherein the support surface includes two support smooth belts placed on either side of the toothed belt.

3. The sorting outlet device according to claim 1, wherein the synchronization member is a chain suitable for co-operating with a lug or with a cog on the retaining member.

4. The sorting outlet device according to claim 1, wherein the support surface and the synchronization member are arranged such that the flat articles are not in contact with the synchronization member.

5. The sorting outlet device according to claim 1, wherein neither the synchronization member nor the support surface is provided with drive means.

6. A postal sorting machine having a plurality of sorting outlet devices, wherein each of the plurality of sorting outlet devices is a sorting outlet device according to claim 1.

7. A sorting outlet device for stacking flat articles on edge, said device comprising:

a frame supporting a support surface on which a stack of said flat articles can be formed;

a retaining element disposed at a front end of the stack for retaining the stack as the flat articles are inserted and pushed on-edge one-by-one in a main direction against the retaining element, said retaining element being mounted to move relative to the frame and being associated with means arranged so as to exert a return force on the stack of flat articles in such a manner as to retain the stack of flat articles; and a synchronization member that is distinct from the support surface, the synchronization member being constrained to move in translation in the main direction both with the retaining element and with the support surface, wherein the support surface is mounted to be free to move in translation relative to the frame in the main direction, wherein the support surface is configured to move synchronously with the movement of the retaining element in said direction, and wherein neither the synchronization member nor the support surface is provided with drive means.

* * * * *